US006477758B2

(12) United States Patent
Krebel

(10) Patent No.: US 6,477,758 B2
(45) Date of Patent: Nov. 12, 2002

(54) GREASE FILTER REMOVER

(76) Inventor: Ronald J. Krebel, 6905 Deer Hill Rd., Waterloo, IL (US) 62298

( * ) Notice: Subject to any disclaimer, the term of this patent is extended or adjusted under 35 U.S.C. 154(b) by 0 days.

(21) Appl. No.: 09/775,520

(22) Filed: Feb. 5, 2001

(65) Prior Publication Data

US 2002/0008059 A1 Jan. 24, 2002

Related U.S. Application Data

(60) Provisional application No. 60/183,964, filed on Feb. 22, 2000.

(51) Int. Cl.[7] ..... B23P 19/04
(52) U.S. Cl. ..... 29/267; 29/235; 254/131
(58) Field of Search ..... 29/267, 278, 237, 29/235, 270, 227; 254/131, 131.5

(56) References Cited

U.S. PATENT DOCUMENTS

D256,442 S * 8/1980 Martin ..... D10/77
5,423,114 A * 6/1995 Johnson ..... 29/267
5,495,651 A * 3/1996 Tsuha ..... 29/235

* cited by examiner

*Primary Examiner*—Timothy V. Eley
*Assistant Examiner*—Lee Wilson

(57) ABSTRACT

The grease filter remover is a device that by working the handle the head pivots moving the stationary fingers. Moving the handle up and out will pivot top of head inward moving lower fingers out and top fingers in. Moving handle down and inward will pivot bottom of head inward moving lower finger inward and top of finger outward.

3 Claims, 3 Drawing Sheets

FIG 2
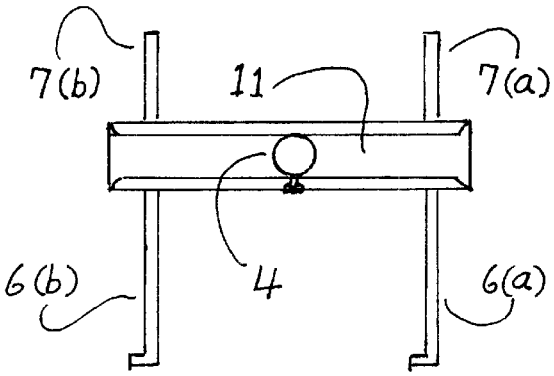
FIG 3
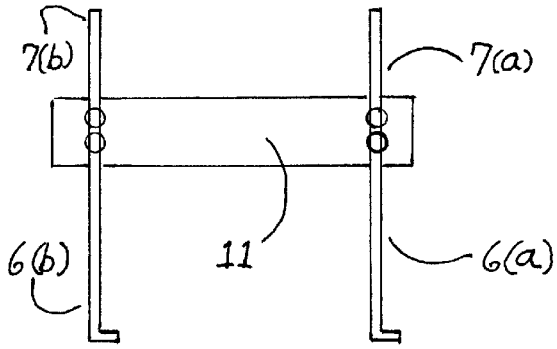
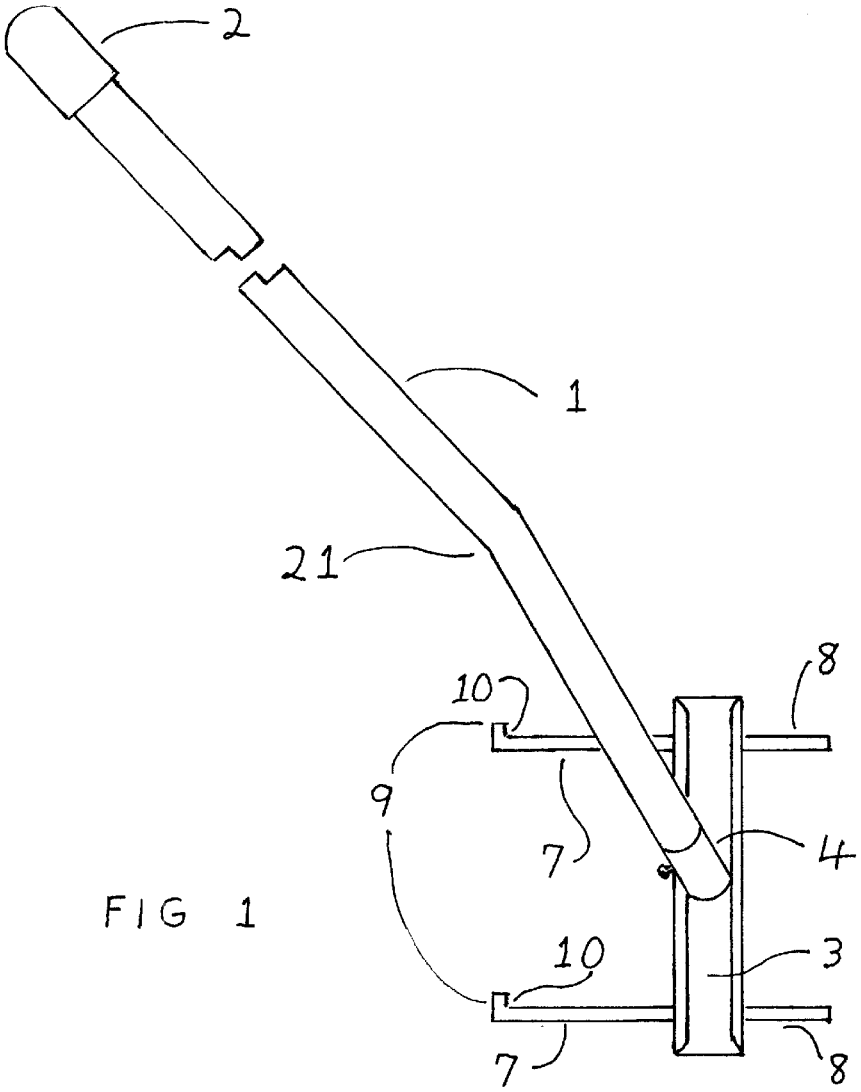
FIG 1

FIG 5
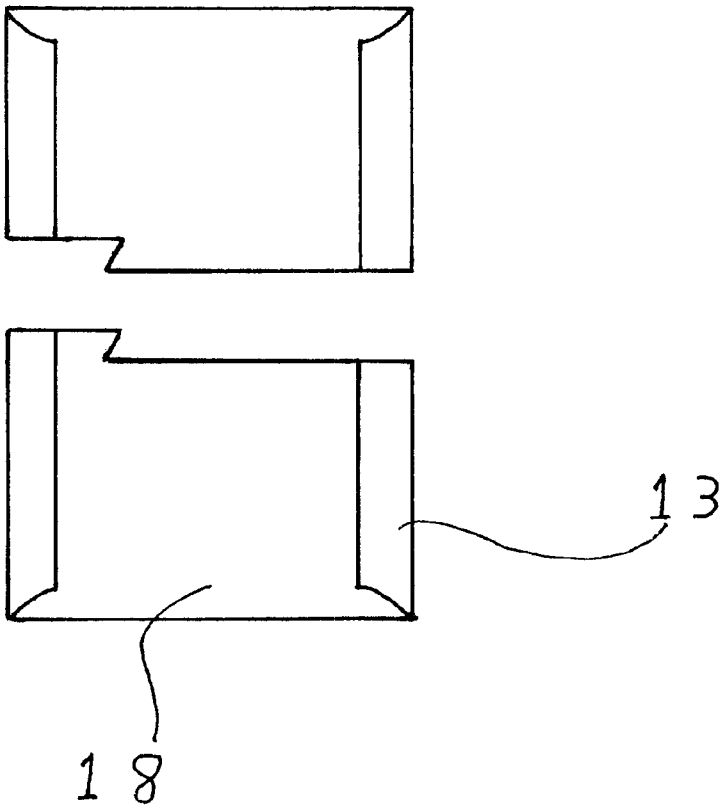
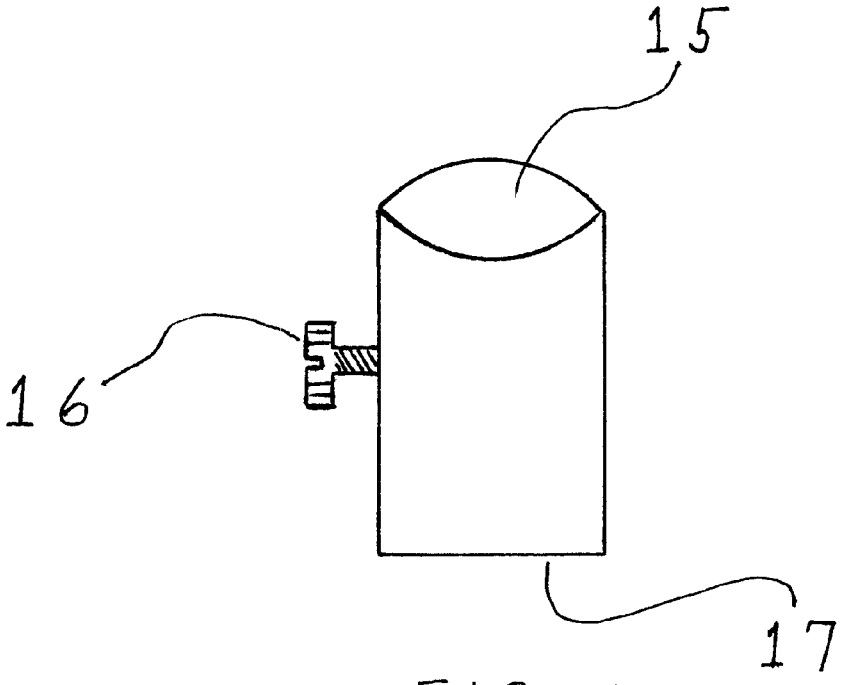
FIG 4

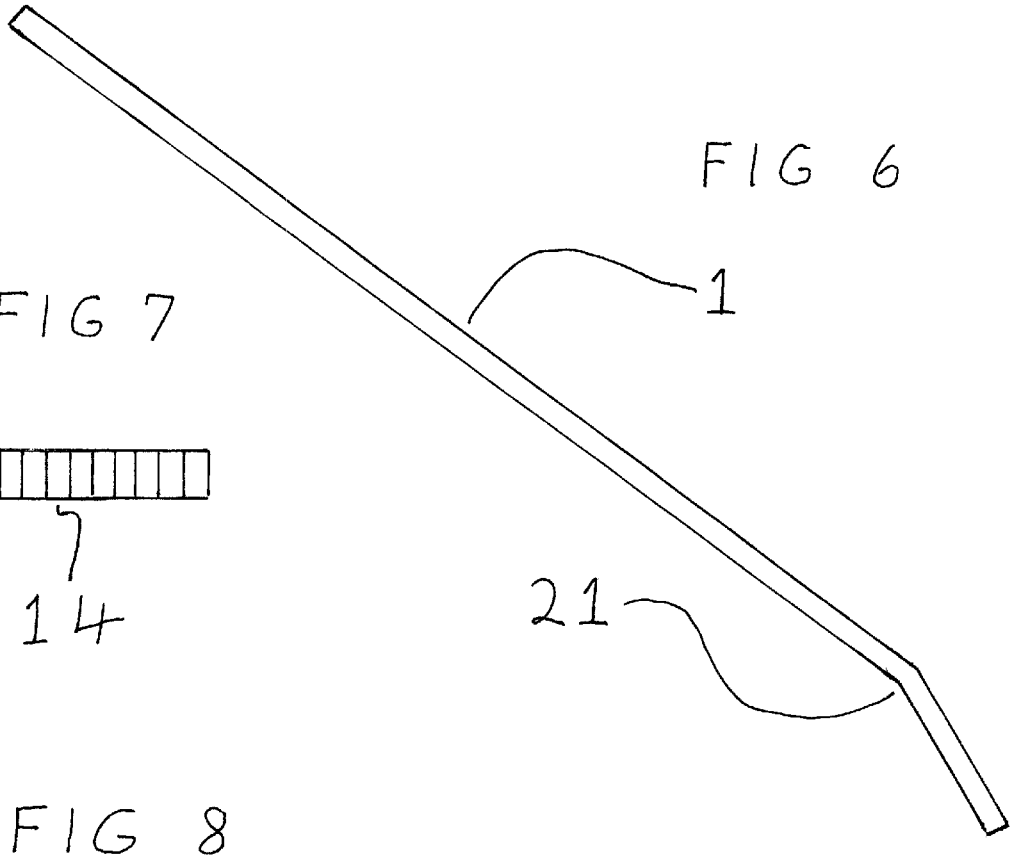
FIG 6
FIG 7
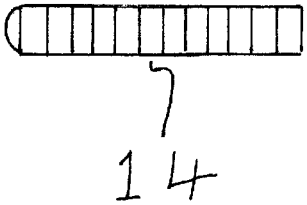
FIG 8
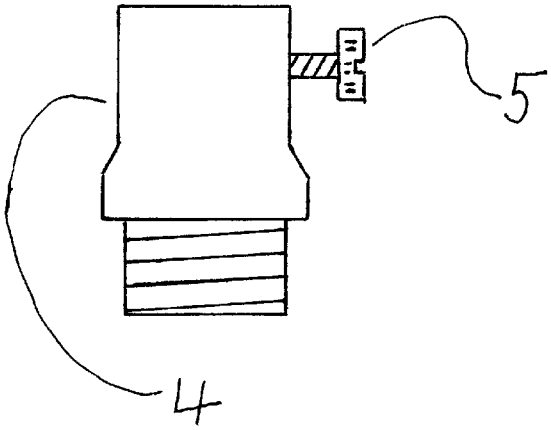
FIG 9
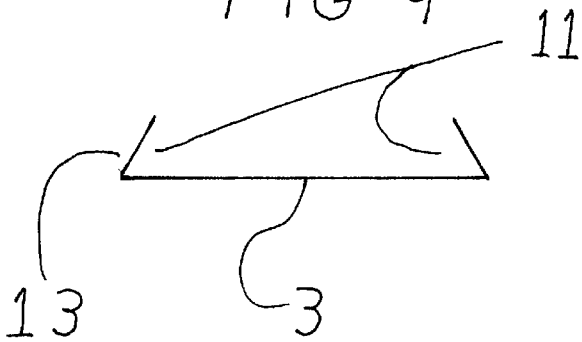

GREASE FILTER REMOVER

GROSS REFERENCE TO RELATED APPLICATIONS

This application claims benefit of provisional application No. 60,183,964 filed Feb. 22, 2000.

BACKGROUND OF INVENTION

The Grease filter is used in commercial kitchens and restaurants. They are located above the cooking area, slanted with the top of the filter leaning toward the front of the cooking surface. A grease filter is made of stainless steel and measures 15½ inch by 24½ inch by 1¾ inch thick and weighs approximately 5 pounds. It's make up provides a ⅝ inch lip surrounding the entire filter panel. The grease filter vary in size and in location but the general make up is the same. The location of the filters makes it difficult to change without the aid of using a ladder, while reaching over the cooking surface to remove. Grease filters have to be regularly cleaned to remove grease and other contaminants from the cooking of food. This device is used to remove and to re-install the grease filter.

The handle is made of ½ inch steel thinwall conduit 60 inches long with a 20 degree or so bend a 7 inches from end. It is connected and locked into place on the head of the device by use of a ½ inch conduit connecter welded into place in the center of a steel channel 1 inch wide 1/16 inch thick 8 inches long.(The head). Two metal rods 9½ inches long 3/16 inch steel round stock with a 90 degree bend ½ inch from end are welded into place perpendicular to channel, 6¼ inches apart center to center, ⅞ inch from each end. The top of each finger is 3 inches long from channel. The bottom of each finger having the 90 degree bend ½ inch from end pointing to the left.

To remove filter from ceiling insert top finger in lip at top center of filter, lift up then with lower fingers resting between panels of filter slide device to the left inserting 90 degree fingers behind panels. Then raise handle up and outward to move bottom of filter from bottom of filter holder and remove from channel. The head being a fulcrum which moves lower fingers out, moving filter out of filter holder.

To install filter back in holder insert top of fingers into top center of filter, with lower fingers inserted behind panels raise and insert filter into top holder, lower handle to bring bottom edge of filter in lower filter holder. Slide device to the right and remove filter remover.

BRIEF SUMMARY OF INVENTION

My invention "The Grease Filter Remover" will help in the removal of grease filter without standing on ladder and leaning over a cooking surface. This device is design to pickup and hold filter and lift out of filter holding brackets then lowered all by standing on floor. After filter is cleaned, re-install filter. This device will save time to a minimum so filter will be cleaned more often. Using this device will also reduced the chance of being injured.

BRIEF DESCRIPTION OF THE DRAWINGS

FIG. 1 Grease Filter Removing Tool shown complete. Elongated shaft {1} handle grip {2} for easy gripping and comfort. A 20 degree bend {21} in the shaft {1} is 7 approximately 7 inches from the end of a coupling {4}. The bend {21} places the correct angle to insert the elongated rods {6*a*,7*a*} and {6*b*,7*b* with short fingers} into the top lip of the grease filter. The Filter removing tool is then lifted up to raise the filter out of a lower holding bracket. Handle (2) is now pivoted down to bring the elogated rods between louvers of filter, the 90 degree bend {8} should now be far enough into louvers. Then slide handle {2} to left to place 90 degree tip under louvers. Now pivot handle up tip {9} with a bend (10) thereof which will pull the filter out and away from louver holding bracket. Lower handle {2} and filter is out and ready for cleaning. Handle {1} is held in place with a head {3} by being inserted into a coupling {4} and tightening an adjusting screw {5}.

FIG. 2 Showing Head of filter removing device the shaft detached from {1}. Coupling {4} shown attached in center of channel end to end. Two elongated rods {6*a*,7*a*} and {6*b*,7*b*} attached to the channel {11} 6¼ inches apart center to center, and approximately ⅞ inch from each end of channel.

FIG. 3 Head of Filter Removing Tool detached from shaft {1}, turned over showing elongated rods {6*a*,7*a*} and {6*b*, 7*b*} attached to channel {11}.

FIG. 4 Coupling {4} shown separate with openings (15 & 17) for inserting shaft {1}. Locking screw {5} for tightening shaft {1} in place.

FIG. 5 Enlarge view of channel {11} made of approximately 18 Ga. Steel for light weight handling with rolled edges {13} for maximum strength to keep from bending under weight applied.

FIG. 6 Handle made from ½ inch steel thinwall conduit 60 inches long with a 20 degree or so bend 7 inches from end.

FIG. 7 Plastic handle grip (14) to slide over handle end.

FIG. 8 Handle connector enlarged, (to be seen) to be welded in center of channel, with channel side up.

FIG. 9 End view of channel enlarged, (to be seen) channel side up.

DETAILED DESCRIPTION OF INVENTION

With reference to the drawings, the invention is concerned with the removal, the cleaning, and re-installing of Baffle Grease Filters. (Not shown) The channel {11} with a bend is made of 18 gauge steel with rolled edges {13} to give it a channeled effect for strength while being light weight. The head {3} is 1 inch wide and 8 inches long. In the center of the channel {11} of head {3}, there is a coupling {4} attached for coupling a shaft {1} with a bend {21} inserted into channel {11}. The two elongated rods {6*a*,7*a*} and {6*b*,7*b*} are each single rods doing two distinct actions. Thus these two rods are mentioned as two separate items attached to the underside of channel {11} and head {3} being spaced 6¼ inches apart center and being approximately ⅞ inch from the channel end. The elongated rods (6*a*,7*a*} and {6*b*,7*b*} are attached on the underside of the channel with straight ends of the elongated rods (6*a*,7*a*} and {6*b*,7*b*} being 3 inches from the channel's rolled edges {13}. The 90 degree bend of elongated rods (6*a*,7*a*} and {6*b*,7*b*} are 5 inches from rolled edges of channel {11}, with a 90 degree bend {8} of elongated rods (6*a*,7*a*} and {6*b*,7*b*} tips {9} with a bend (10) thereof facing to right and horizontal with channel {11} with underside facing up. The shaft {1} is made of steel pipe 0.706 inch in diameter, steel pipe 60 inches long with a soft plastic handle {2} on an opposite end of the shaft {1} for comfort. The shaft {1} is inserted into coupling {4} and locked into place by turning locking screw {5} until tight.

What I claim as my invention is:

1. A grease filter removing apparatus, said apparatus comprising:

a shaft having first and second ends; a bend located in the shaft between the first and second ends; a handle mounted on said first end and a coupling connected to said second end; a head connected to said coupling; said head including a pair of lips; and two round elongated rods, each containing a bend at an end thereof; said rods being mountable to said lips for insertion into said filter for removal thereof.

2. The apparatus as set forth in claim 1, wherein said bend of each elongated rod is substantially 90 degrees.

3. The apparatus as set forth in claim 1, wherein said bend of said shaft is substantially 20 degrees and is located approximately 7 inches from said second end of said shaft.

* * * * *